US011249425B2

(12) United States Patent
Shibahara

(10) Patent No.: US 11,249,425 B2
(45) Date of Patent: Feb. 15, 2022

(54) FIXING APPARATUS THAT CONTROLS POWER SUPPLIED TO HEATER ACCORDING TO INITIAL TEMPERATURE OF NIP REGION, AND IMAGE FORMING APPARATUS

(71) Applicant: KYOCERA Document Solutions Inc., Osaka (JP)

(72) Inventor: Masami Shibahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/113,779

(22) Filed: Dec. 7, 2020

(65) Prior Publication Data

US 2021/0181659 A1 Jun. 17, 2021

(30) Foreign Application Priority Data

Dec. 12, 2019 (JP) ..... JP2019-224900

(51) Int. Cl.
*G03G 15/20* (2006.01)
*G03G 13/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/2039; G03G 15/80
See application file for complete search history.

(56) References Cited

U.S. PATENT DOCUMENTS 5,801,360 A * 9/1998 Oba ..... G03G 15/2003 219/216
2012/0294641 A1 11/2012 Nakahara et al.

FOREIGN PATENT DOCUMENTS

JP 2012-242618 A 12/2012

* cited by examiner

*Primary Examiner* — Clayton E. LaBalle
*Assistant Examiner* — Michael A Harrison
(74) *Attorney, Agent, or Firm* — IP Business Solutions, LLC

(57) ABSTRACT

A fixing apparatus includes a fixing device, a temperature sensor, a storage device, and a control device. The control device selects, before start of power supply to a heater of the fixing device, a temperature characteristic of an initial temperature the same as or approximate to a temperature of a nip region detected by the temperature sensor, out of respective temperature characteristics of a plurality of initial temperatures stored in the storage device, calculates a predicted temperature that may be reached a prescribed time after the start of power supply to the heater, on a basis of the selected temperature characteristic, and increases the power to the heater by a predetermined first value, when a temperature, detected by the temperature sensor the prescribed time after the start of power supply to the heater, is lower than the predicted temperature.

7 Claims, 7 Drawing Sheets

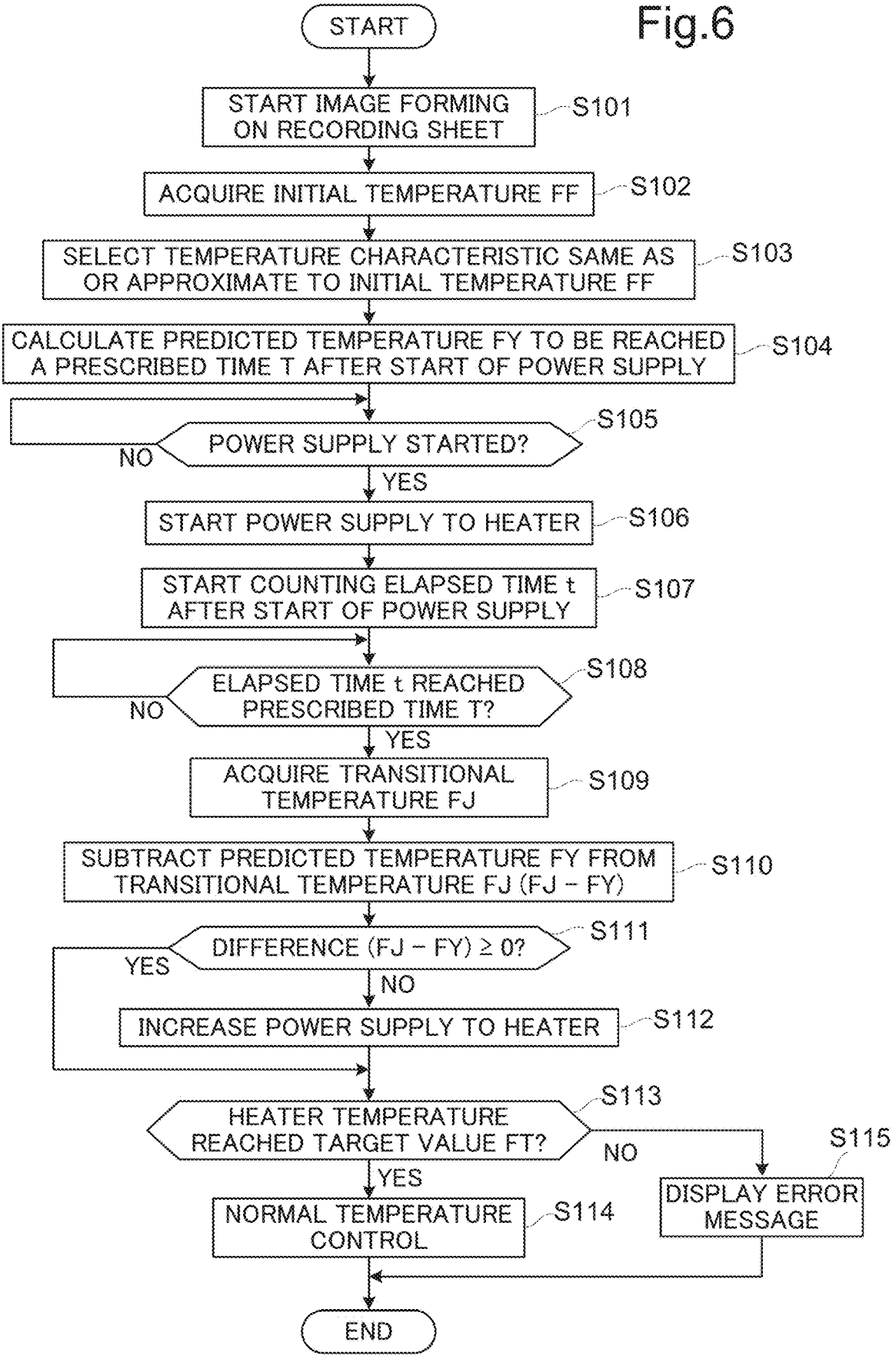
Fig.6
START
START IMAGE FORMING ON RECORDING SHEET
S101
ACQUIRE INITIAL TEMPERATURE FF
S102
SELECT TEMPERATURE CHARACTERISTIC SAME AS OR APPROXIMATE TO INITIAL TEMPERATURE FF
S103
CALCULATE PREDICTED TEMPERATURE FY TO BE REACHED A PRESCRIBED TIME T AFTER START OF POWER SUPPLY
S104
POWER SUPPLY STARTED?
S105
NO
YES
START POWER SUPPLY TO HEATER
S106
START COUNTING ELAPSED TIME t AFTER START OF POWER SUPPLY
S107
ELAPSED TIME t REACHED PRESCRIBED TIME T?
S108
NO
YES
ACQUIRE TRANSITIONAL TEMPERATURE FJ
S109
SUBTRACT PREDICTED TEMPERATURE FY FROM TRANSITIONAL TEMPERATURE FJ (FJ − FY)
S110
DIFFERENCE (FJ − FY) ≥ 0?
S111
YES
NO
INCREASE POWER SUPPLY TO HEATER
S112
HEATER TEMPERATURE REACHED TARGET VALUE FT?
S113
NO
YES
NORMAL TEMPERATURE CONTROL
S114
DISPLAY ERROR MESSAGE
S115
END

FIXING APPARATUS THAT CONTROLS POWER SUPPLIED TO HEATER ACCORDING TO INITIAL TEMPERATURE OF NIP REGION, AND IMAGE FORMING APPARATUS

INCORPORATION BY REFERENCE

This application claims priority to Japanese Patent Application No. 2019-224900 filed on Dec. 12, 2019, the entire contents of which are incorporated by reference herein.

BACKGROUND

The present disclosure relates to a fixing apparatus that fixes an image formed of a developing agent on a recording sheet by heat-pressing, and an image forming apparatus that includes the fixing apparatus.

Many of existing image forming apparatuses are configured to apply a toner to an electrostatic latent image on an image carrier to form a toner image, transfer the toner image from the image carrier to a recording sheet, and fix the toner image onto the recording sheet by heat-pressing. The heat-pressing of the toner image to the recording sheet is performed by a fixing device. For example, a fixing device based on an on-demand system is known, that includes a ceramic heater, which is a plane heater, for heating the recording sheet through an endless fixing belt, the recording sheet being pressed at a nip region defined between the fixing belt and a pressure roller, to thereby press and heat the toner image on the recording sheet.

The ceramic heater can heat up very quickly, and reaches approximately 100° C. in one second. Accordingly, although the ceramic heater is advantageous in reducing power consumption, the temperature of the ceramic heater has to be instantaneously controlled.

In addition, the image forming apparatuses are broadly used in many countries, where the utility power supply voltages vary depending on the district. Throughout Europe, for example, the utility power supply voltages are 220V, 230V, or 240V, depending on the country. On the other hand, the same heaters are employed in common irrespective of the district, as the heater for the fixing device, and therefore the heaters are designed to operate in a voltage range of −4% to +4% from 230V, which is the average utility power supply voltage. However, the temperature of the heater may become too low or too high, owing to the difference in utility power supply voltage.

To minimize the lack or excess in temperature of the heater, for example, a technique is employed to control the power supplied to the heater, according to the heater temperature detected by a thermistor at a predetermined control cycle, and change the control cycle, for example, according to the change rate of the heater temperature detected, so as to suppress the overshoot of the heater temperature.

SUMMARY

The disclosure proposes further improvement of the foregoing technique.

In an aspect, the disclosure provides a fixing apparatus including a fixing device, a temperature sensor, a storage device, and a control device. The fixing device heats, with a heater, a recording sheet on which an image has been formed by a developing agent, while holding the recording sheet at a nip region with a pressure, thereby fixing the image on the recording sheet. The temperature sensor detects a temperature of the nip region. The storage device contains temperature characteristics of the nip region varying from an initial temperature owing to start of power supply to the heater, with respect to each of a plurality of the initial temperatures of the nip region. The control device includes a processor, and acts as a controller when the processor executes a control program. The controller selects, before the start of power supply to the heater, a temperature characteristic of the initial temperature same as or approximate to a temperature detected by the temperature sensor, out of the temperature characteristics of the respective initial temperatures stored in the storage device, calculates a predicted temperature to be reached a prescribed time after the start of power supply to the heater, on a basis of the selected temperature characteristic, and increases the power to the heater by a predetermined first value, when a temperature, detected by the temperature sensor the prescribed time after the start of power supply to the heater, is lower than the predicted temperature.

In another aspect, the disclosure provides an image forming apparatus including an image forming device that forms an image created by a developing agent on a recording sheet, and the foregoing fixing apparatus.

BRIEF DESCRIPTION OF THE DRAWINGS

FIG. 6 is a flowchart showing a control process of power supplied to the heater.

DETAILED DESCRIPTION

Figure 1:
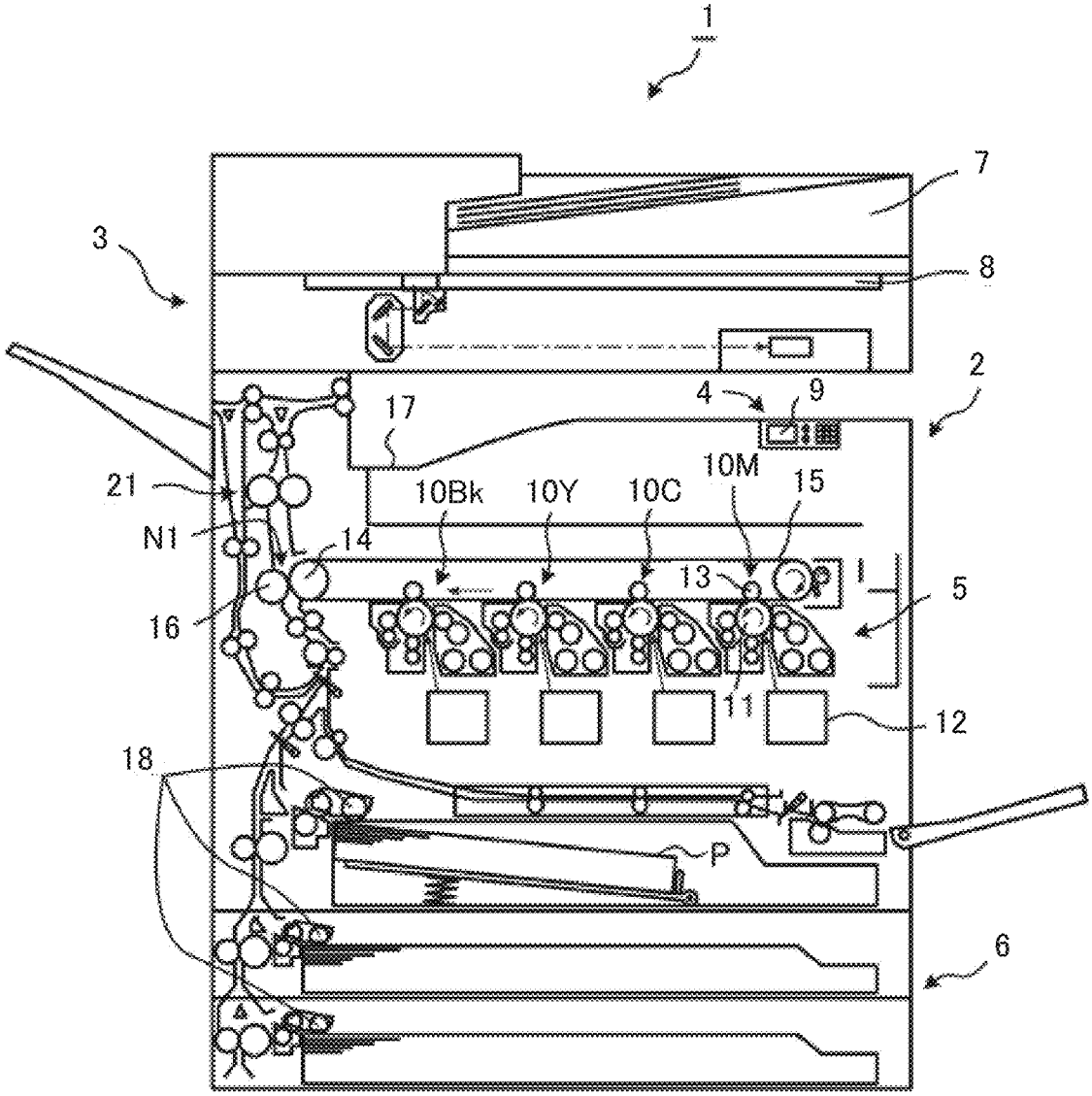
FIG. 1 is a front cross-sectional view showing a configuration of an image forming apparatus that includes a fixing apparatus according to an embodiment of the disclosure.

Hereafter, an image forming apparatus that includes a fixing apparatus according to an embodiment of the disclosure will be described, with reference to the drawings. FIG. 1 is a front cross-sectional view showing a configuration of the image forming apparatus 1 that includes the fixing apparatus according to the embodiment of the disclosure.

The image forming apparatus 1 is a multifunction peripheral having a plurality of functions such as facsimile communication, copying, printing, and scanning. The image forming apparatus 1 includes a main body 2 and an image reading device 3. The main body 2 includes an operation device 4, an image forming device 5, the fixing device 21, and a paper feed device 6.

The image reading device 3 includes an automatic document feeder (ADF), having a document feeding device 7 that transports a source document, and a scanner that optically reads the source document transported by the document feeding device 7, or placed on a contact glass 8. The image reading device 3 emits light to the source document from a light emitter, and receives the reflected light with a charge-coupled device (CCD) sensor, to thereby read the source document and acquire image data. The image data acquired by the image reading device 3 is stored in a built-in HDD or a personal computer connected via a network.

The operation device 4 is provided on the front side of the image forming apparatus 1, at a position close to the image reading device 3. A user can input, through the operation device 4, instructions related to the functions that the image forming apparatus 1 is configured to perform. The operation device 4 includes a display device 9, having a display on which a touch panel is superposed. The display device 9 displays various screens related to the functions that the image forming apparatus 1 is configured to perform.

The image forming device 5 forms a toner image on a recording sheet P delivered from the paper feeding device 6, on the basis of the image data acquired by the image reading device 3, or image data transmitted from a personal computer connected via a network, other facsimile machines, and so forth.

The image forming device 5 includes image forming units 10M, 10C, 10Y, and 10Bk (hereinafter may simply be referred to as image forming unit 10). The image forming unit 10 includes a photoconductor drum 11, a toner cartridge in which a toner is stored, a charging device that uniformly charges the surface of the photoconductor drum 11, an exposure device 12 that exposes the surface of the photoconductor drum 11 to light, thereby forming an electrostatic latent image, a developing device that supplies the toner to the photoconductor drum 11 thereby developing the electrostatic latent image into a toner image, and a primary transfer roller 13.

When color printing is executed, image the image forming unit 10M for magenta, the image forming unit 10C for cyan, the image forming unit 10Y for yellow and the image forming unit 10Bk for black of the forming device 5 each perform the charging, the exposure, and the development according to image data composed of the corresponding color component, to thereby form the toner image on the photoconductor drum 11, and transfer the toner image on an intermediate transfer belt 15 wound around a drive roller 14 and a follow-up roller, using the primary transfer roller 13.

The intermediate transfer belt 15 includes an image-carrying face, on which the toner image is to be transferred, over the outer circumferential surface. The intermediate transfer belt 15 is driven to rotate by the drive roller 14, in contact with the circumferential surface of the photoconductor drum 11. The intermediate transfer belt 15 endlessly runs between the drive roller 14 and the follow-up roller, in synchronization with the rotation of the photoconductor drum 11.

The toner images of the respective colors, to be transferred onto the intermediate transfer belt 15, are superposed on each other at an adjusted timing on the intermediate transfer belt 15, so as to form a colored toner image.

A secondary transfer roller 16 transfers the colored toner image formed on the surface of the intermediate transfer belt 15, onto the recording sheet P transported from the paper feed device 6, at a nip region N1 defined between the drive roller 14 and the secondary transfer roller 16, across the intermediate transfer belt 15.

The fixing device 21 fixes, onto the recording sheet P, the colored toner image formed thereon. The recording sheet P subjected to the fixing process and having the color image formed thereon, is discharged to an output tray 17.

The paper feed device 6 includes a plurality of paper cassettes. When a size of the recording sheet P is inputted by the user through the operation device 4, a pickup roller 18 of the paper cassette containing the recording sheet P of the inputted size is activated, so that the recording sheet P is delivered to the transport route.

Figure 2:
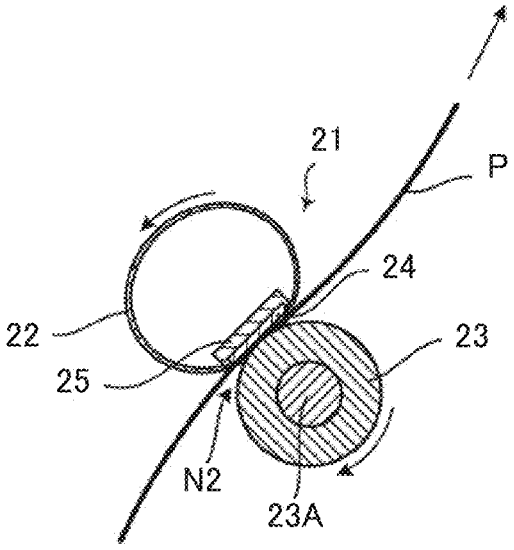
FIG. 2 is a cross-sectional view showing a configuration of the fixing device.

FIG. 2 is a cross-sectional view showing a configuration of the fixing device 21. As shown in FIG. 2, the fixing device 21 includes an endless fixing belt 22, a pressure roller 23 located in contact with the fixing belt 22 so as to define a nip region N2 in collaboration with the fixing belt 22, a heater 24 that heats the fixing belt 22, and a base member 25 that supports the heater 24. The heater 24 is a plane heater based on the on-demand system.

The fixing belt 22 includes a hollow cylindrical base layer formed of a metal or a synthetic resin, on which an elastic layer for example formed of a silicone rubber, and a release layer formed of a fluorine-based resin such as PFA or PTFE are superposed. The fixing belt 22 is installed so as to rotate.

The pressure roller 23 is a cylindrical member including a cylindrical core material formed of a metal, on which an elastic layer for example formed of a silicone rubber, and a release layer formed of a fluorine-based resin such as PFA or PTFE are superposed. The axial direction of the pressure roller 23 and the axial direction of the fixing belt 22 are parallel to each other.

A shaft 23A, extending axially of the pressure roller 23, is provided at a radially central position of the pressure roller 23, when viewed in the axial direction thereof. The end portions of the shaft 23A are each rotatably supported by a bearing.

The pressure roller 23 is biased so as to contact the outer circumferential surface of the fixing belt 22. Accordingly, the nip region N2 is defined between the pressure roller 23 and the fixing belt 22. The pressure roller 23 driven to rotate by a drive source, via a drive mechanism. When the pressure roller 23 rotates, the fixing belt 22 is caused to rotate in contact with the pressure roller 23, so as to follow up the rotation of the pressure roller 23.

The heater 24 is a plane ceramic heater that heats up very quickly, and serves to heat the recording sheet P via the fixing belt 22.

The recording sheet P having the colored toner image formed thereon as above is pressed and heated at the nip region N2 while being transported by the pressure roller 23 and the fixing belt 22, so that the colored toner image is fixed onto the recording sheet P.

Figure 3:
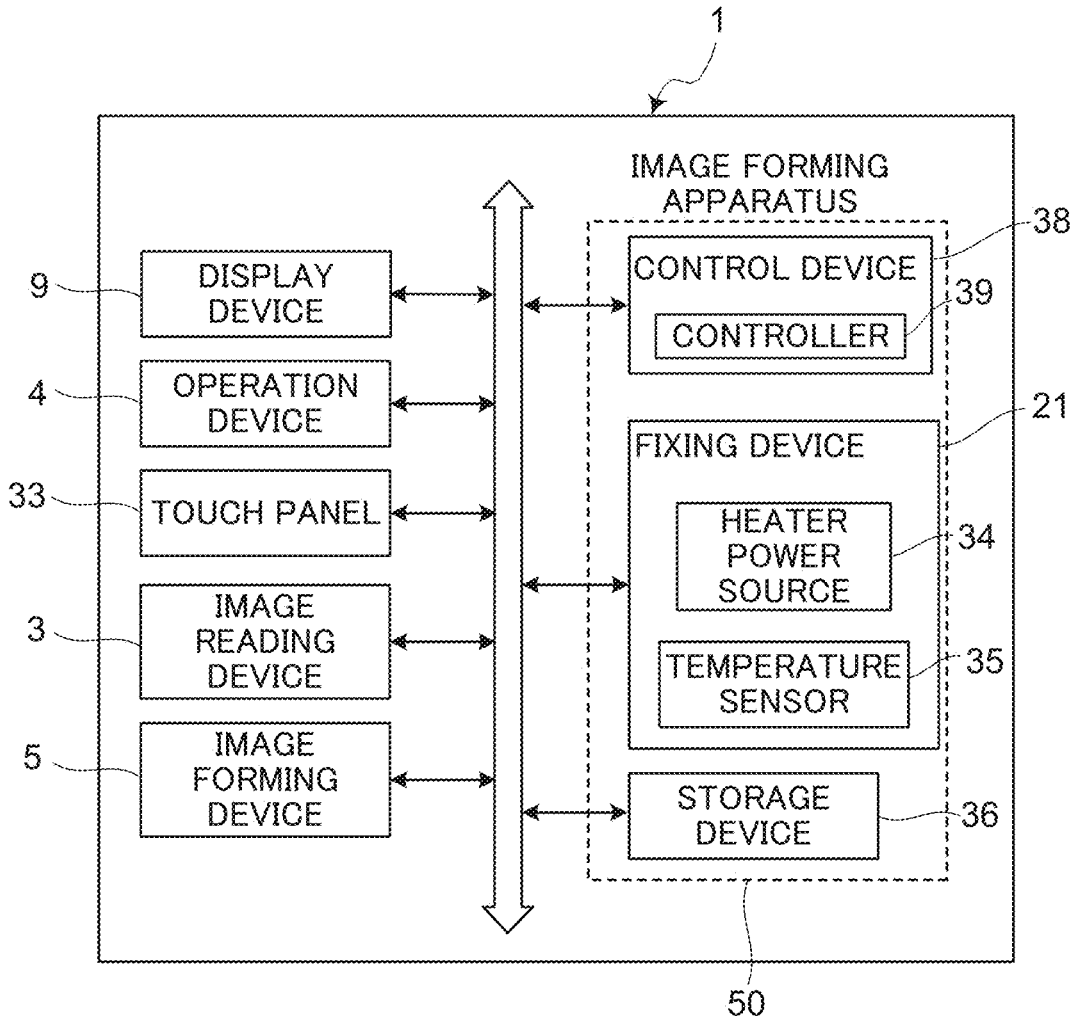
FIG. 3 is a functional block diagram showing an essential internal configuration of the image forming apparatus.

Hereunder, a configuration related to the control of the image forming apparatus 1 will be described. FIG. 3 is a functional block diagram showing an essential internal configuration of the image forming apparatus 1. As shown in FIG. 3, the image forming apparatus 1 includes the image reading device 3, the image forming device 5, the display device 9, the operation device 4, a touch panel 33, the fixing device 21, a storage device 36, and a control device 38. The mentioned components are configured to transmit and receive data or signals to and from each other, via a bus.

The display device 9 is, for example, constituted of a liquid crystal display (LCD) or an organic light-emitting diode (OLED) display.

The operation device 4 includes physical keys such as a tenkey, an enter key, and a start key.

The touch panel 33 is overlaid on the screen of the display device 9. The touch panel 33 is based on a resistive film or electrostatic capacitance, and configured to detect a contact (touch) of the user's finger made on the touch panel 33, along with the touched position, and outputs a detection signal indicating the coordinate of the touched position, to a controller 39 of the control device 38 to be subsequently described. The touch panel 33 serves, in collaboration with the operation device 4, as an operation device for receiving an instruction of the user inputted through the screen of the display device 9.

The fixing device 21 includes a heater power source 34 that supplies power to the heater 24 shown in FIG. 2, and a temperature sensor 35 that detects a temperature F of the nip region N2 between the pressure roller 23 and the fixing belt 22. The temperature sensor 35 may be, for example, a thermistor.

The storage device 36 is a large-capacity storage device such as a solid-state drive (SSD) or a hard disk drive (HDD), and contains various application programs and various types of data.

The control device 38 includes a processor, a random-access memory (RAM), a read-only memory (ROM), and so forth. The processor is, for example, a central processing unit (CPU), an application specific integrated circuit (ASIC), or a micro processing unit (MPU). The control device 38 acts as a controller 39, when the processor executes a control program stored in the ROM or the storage device 36.

The controller 39 executes overall control of the image forming apparatus 1. The control device 38 is connected to the image reading device 3, the image forming device 5, the display device 9, the operation device 4, the touch panel 33, the heater power source 34, the temperature sensor 35, and the storage device 36. The controller 39 controls the operation of the mentioned components, and transmits and receives data and signals to and from each of those components. The fixing apparatus 50 is comprised of the fixing device 21, the storage device 36, and the control device 38.

The controller 39 serves as a processing device that executes various operations necessary for the image forming to be performed by the image forming apparatus 1. The controller 39 also receives operational instructions inputted by the user, in the form of a detection signal outputted from the touch panel 33, or through a press of a physical key of the operation device 4. Further, the controller 39 is configured to control the display operation of the display device 9.

Further, the controller 39 controls the heater power source 34 according to the temperature F of the nip region N2 between the pressure roller 23 and the fixing belt 22, detected by the temperature sensor 35, to adjust the AC power supplied to the heater 24 from the heater power source 34.

Figure 4:
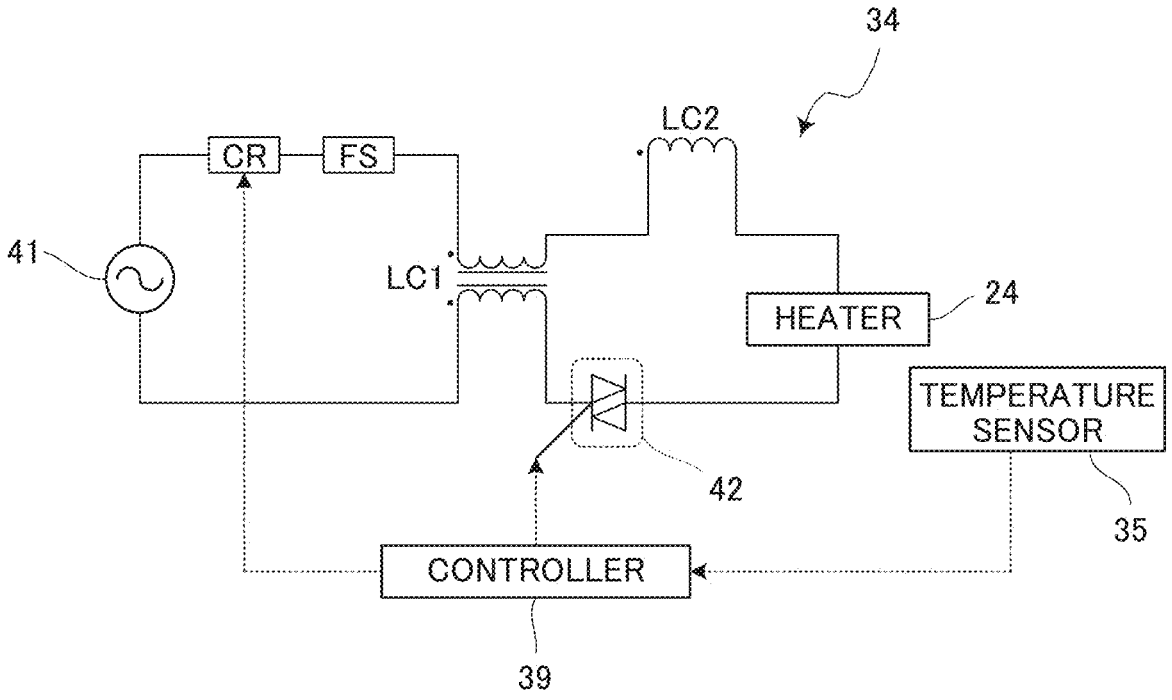
FIG. 4 is a circuit diagram showing a configuration of a heater power source that supplies power to a heater of the fixing device.

FIG. 4 is a circuit diagram showing a configuration of the heater power source 34 that supplies power to the heater 24 of the fixing device 21.

As shown in FIG. 4, a relay CR, a fuse FS, a choke coil LC1, an AC switching device 42, and a choke coil LC2 are provided to constitute the heater power source 34, between the utility power supply 41 and the heater 24.

The AC switching device 42 includes a switching element (e.g., bidirectional thyristor) connected in series to the heater 24, to turn on or off the supply of the AC power to the heater 24, using the switching element. Since the AC power is supplied to the heater 24, the bidirectional thyristor capable of supplying the current in both directions is employed as the AC switching device 42.

The controller 39 turns on the relay CR, adjusts the AC power supplied to the heater 24 by controlling the on/off of the AC switching device 42 according to the temperature F of the nip region N2 between the pressure roller 23 and the fixing belt 22, detected by the temperature sensor 35, so as to match the temperature F of the nip region N2 with a target value FT (fixing temperature used for actual fixing operation). The on/off control of the AC switching device 42 performed by the controller 39 is a zero-cross control including turning the AC switching device 42 on or off when the AC power supplied to the heater 24 is zero, and the controller 39 adjusts the AC power supplied to the heater 24 at least every half a cycle.

With the image forming apparatus 1 configured as above, for example when the user sets a source document on the image reading device 3 and presses the start key of the operation device 4, the controller 39 causes the image reading device 3 to read the image of the source document, causes the image forming device 5 to print the toner image of the source document on the recording sheet, and causes the fixing device 21 to fix the toner image onto the recording sheet.

Now, since the fixing device 21 includes the plane ceramic heater as the heater 24 so as to perform under the on-demand system, the heater 24 heats up very quickly, and therefore the temperature of the heater 24 has to be instantaneously controlled.

However, in terms of the temperature characteristic of the nip region N2 between the pressure roller 23 and the fixing belt 22, which changes with time after start of power supply to the heater 24, the initial temperature of the nip region N2, before the start of power supply to the heater 24, varies depending on the installation environment or operating conditions, and the slope of the temperature characteristic of the nip region N2 considerably varies, depending on the initial temperature.

Figure 5:
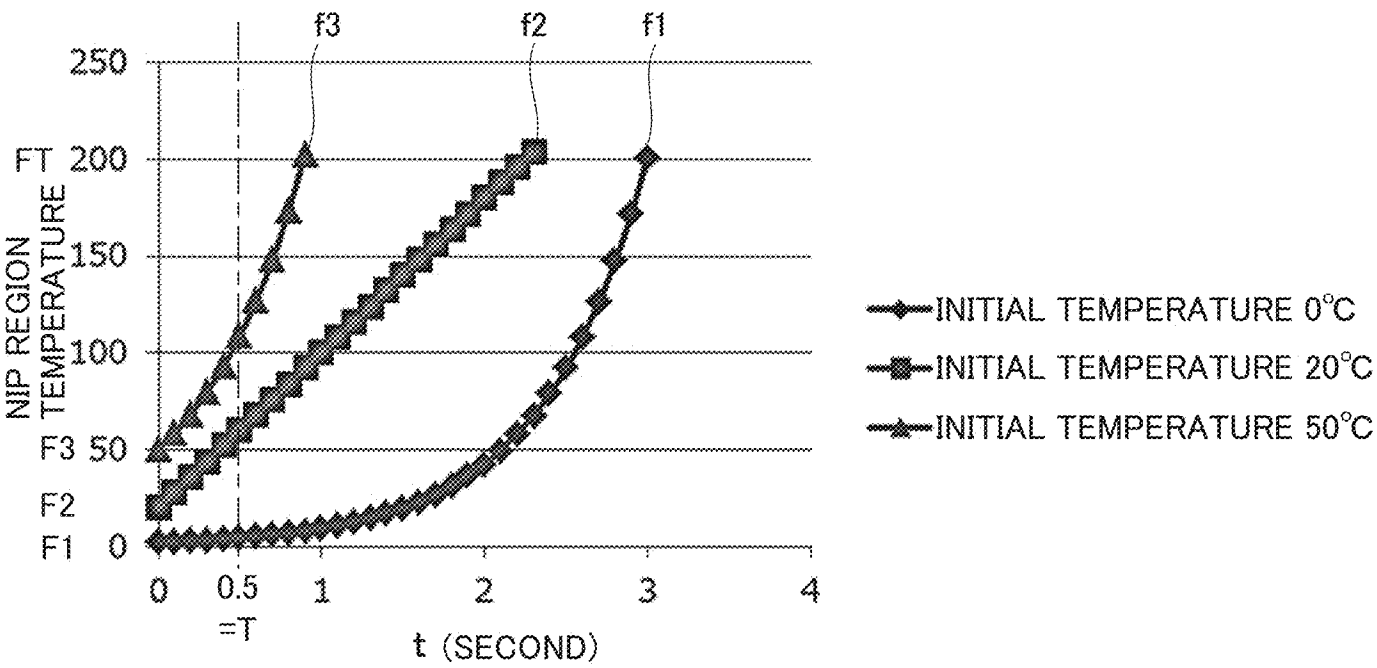
FIG. 5 is a graph showing changes in temperature characteristics of a nip region with lapse of time after start of power supply to the heater, with respect to a plurality of initial temperatures of the nip region before the start of power supply.

FIG. 5 is a graph showing changes in temperature characteristics f1, f2, and f3 of the nip region N2, with the lapse of time t after the start of power supply to the heater 24, with respect to initial temperatures F1 (=0° C.), F2 (=20° C.), and F3 (=50° C.) of the nip region N2 before the start of power supply. As is apparent from the graph of FIG. 5, the temperature of the nip region N2 rises more sharply from the initial temperature, the higher the initial temperature of the nip region N2 is. Accordingly, it is preferable to take the initial temperature of the nip region N2 into consideration, to properly and quickly adjust the temperature of the heater 24.

According to the foregoing background art, the control cycle for the power supplied to the heater is changed according to the change rate of the detected temperature of the heater, to suppress an overshoot of the heater temperature. However, when the slope of the temperature characteristic of the nip region drastically changes as above, it may become difficult to properly control the temperature of the nip region.

In this embodiment, in contrast, the temperature characteristics of the nip region N2, which vary with the lapse of time t from the start of power supply to the heater 24, are stored in the storage device 36, with respect to each of the plurality of initial temperatures. For example, the temperature characteristics f1, f2, and f3 of the nip region N2, which vary with the lapse of time t from the start of power supply to the heater 24, are stored in the storage device 36, with respect to each of the initial temperatures F1 (=0° C.), F2 (=20° C.), and F3 (=50° C.) in the graph of FIG. 5. The controller 39 acquires the temperature F of the nip region N2, detected by the temperature sensor 35 before the start of power supply to the heater 24, as an initial temperature FF, and selects a temperature characteristic the same as or approximate to the initial temperature FF acquired, out of the temperature characteristics f1, f2, and f3 respectively corresponding to the initial temperatures F1, F2, and F3, stored in the storage device 36. The controller 39 then calculates a predicted temperature FY to be reached a prescribed time T after the start of power supply to the heater 24, on the basis of the temperature characteristic selected. Thereafter, the controller 39 starts the power supply to the heater 24, acquires the temperature F detected by the temperature sensor 35 the prescribed time T after the start of power supply as a transitional temperature FJ, and controls the power supplied to the heater 24 on the basis of the difference between the transitional temperature FJ and the predicted temperature FY. For example, when the transitional temperature FJ is lower than the predicted temperature FY, the controller 39 increases the power supplied to the heater 24 from the heater power source 34, by an amount predetermined according to the extent of the difference.

In this embodiment, as described above, the power to the heater 24 is controlled in accordance with the temperature characteristic of the nip region N2 corresponding to the initial temperature FF of the nip region N2, and therefore a lack or excess in temperature of the nip region N2 can be prevented. Here, in the graph of FIG. 5, the time until the temperature F of the nip region N2 reaches the target value FT (=200° C.), after the start of power supply to the heater 24, is shortest (approx. 1 second) when the initial temperature of the nip region N2 is F3 (=50° C.), and therefore the prescribed time T is set to a half of this time, namely 0.5 second.

A control process of the power supply to the heater 24 will now be described in detail, with reference to a flowchart shown in FIG. 6.

For example, when the user sets a source document on the image reading device 3, and inputs an instruction to form the image by pressing the start key of the operation device 4, the controller 39 causes the image reading device 3 to read the image of the source document, and causes the image forming device 5 to start the image forming on the recording sheet, according to the instruction to form the image (step S101).

At this point, before the start of power supply to the heater 24, the controller 39 acquires the temperature F of the nip region N2 detected by the temperature sensor 35 as the initial temperature FF (step S102), and selects the temperature characteristic of the initial temperature the same as or approximate to the initial temperature FF acquired, out of the temperature characteristics f1, f2, and f3 respectively corresponding to the initial temperatures F1, F2, and F3, stored in the storage device 36 (step S103). The expression that one of the initial temperatures F1, F2, and F3 is approximate to the initial temperature FF refers to the case where the difference between these temperatures is within a predetermined range.

Then the controller 39 calculates the predicted temperature FY, to be reached the prescribed time T after the start of power supply to the heater 24, on the basis of the temperature characteristic of the initial temperature FF selected (step S104).

The controller 39 stands by for the start of power supply to the heater 24 (No at step S105), and causes the heater power source 34 to start the power supply to the heater 24 (step S106), at an appropriate timing (Yes at step S105). At this point, the AC power of a predetermined amount is supplied to the heater 24 from the heater power source 34.

The controller 39 starts to count the elapsed time t at the same time as starting the power supply to the heater 24 (step S107), and stands by for the elapsed time t to reach the prescribed time T (No at step S108). When the elapsed time t reaches the prescribed time T (Yes at step S108), the controller 39 acquires the temperature F of the nip region N2, detected by the temperature sensor 35 the prescribed time T after the start of power supply to the heater 24, as the transitional temperature FJ (step S109). The controller 39 then calculates a temperature difference (FJ−FY) by subtracting the predicted temperature FY calculated at step S104 from the transitional temperature FJ (step S110), and decides whether the difference thus calculated (FJ−FY) is equal to or larger than zero (step S111).

When the calculated difference (FJ−FY) is less than zero (No at step S111), in other words when the transitional temperature FJ has not reached the predicted temperature FY, the controller 39 controls the heater power source 34 to increase the AC power supplied to the heater 24, by a predetermined first value according to the amount of the difference (FJ−FY) (step S112). At this point, the controller 39 performs the zero-cross control to turn on or off the AC switching device 42, to increase the AC power supplied to the heater 24 from the heater power source 34 by the predetermined first value, at least every half a cycle.

When the calculated difference (FJ−FY) is equal to or larger than zero (Yes at step S111), in other words when the transitional temperature FJ has reached or exceeded the predicted temperature FY, the controller 39 skips the operation of step S112, and proceeds to step S113.

Then the controller 39 decides whether the temperature F of the nip region N2 detected by the temperature sensor 35 has reached the target value FT within a predetermined time (step S113). When the temperature F of the nip region N2 reaches the target value FT (Yes at step S113), the controller 39 returns to the normal temperature control, including controlling the heater power source 34 on the basis of the temperature F of the nip region N2 detected by the temperature sensor 35, so as to maintain the temperature F of the nip region N2 at the target value FT (step S114).

When the temperature F of the nip region N2 detected by the temperature sensor 35 has not reached the target value FT within the predetermined time (No at step S113), the controller 39 causes the display device 9 to display an error message to the effect that the temperature F of the nip region N2 has not reached the target value FT (step S115). The controller 39 may further transmit the error message, for example, to a terminal device of a service person through a data communication device.

In this embodiment, as described above, the predicted temperature FY of the heater 24, to be reached the prescribed time T after the start of power supply, is calculated on the basis of the temperature characteristic corresponding to the initial temperature FF of the nip region N2, detected by the temperature sensor 35 before the start of power supply to the heater 24, and the AC power supplied to the heater 24 from the heater power source 34 is increased by the predetermined first value, when the difference obtained by subtracting the predicted temperature FY from the transitional temperature FJ, detected by the temperature sensor 35 the prescribed time T after the start of power supply, is less than zero, according to the amount of the difference. Therefore, the temperature of the heater 24 can be properly and quickly controlled, so that a lack in temperature of the nip region N2 can be surely prevented, irrespective of the installation environment or operating conditions of the fixing device 21.

Here, although no reference is made in this embodiment to the adjustment of the AC power supplied to the heater 24 from the heater power source 34, to be performed when the difference obtained by subtracting the predicted temperature FY from the transitional temperature FJ (FJ−FY) is equal to or larger than zero, in other words when the transitional temperature FJ is equal to or higher than the predicted temperature FY, the AC power may also be adjusted in such a case. Specifically, the controller 39 performs the zero-cross control to turn on or off the AC switching device 42, so as to reduce the AC power supplied to the heater 24 from the heater power source 34 by a predetermined second value, at least every half a cycle. Such an arrangement suppresses an overshoot of the temperature of the heater 24.

In this embodiment, further, in the case where the controller 39 performs the normal temperature control (step S114), including controlling the heater power source 34 according to the temperature F of the nip region N2 detected by the temperature sensor 35, so as to maintain the temperature F of the nip region N2 at the target value FT, when the difference obtained by subtracting the predicted temperature FY from the transitional temperature FJ (FJ−FY) is equal to or larger than zero, and the temperature F of the nip region N2 has reached the target value FT, the controller 39 may perform the zero-cross control to turn on or off the AC switching device 42, so as to reduce the AC power supplied to the heater 24 from the heater power source 34 by a predetermined third value, for example at least every half a cycle. Through such an operation, the actual power can be adjusted.

Figure 7:
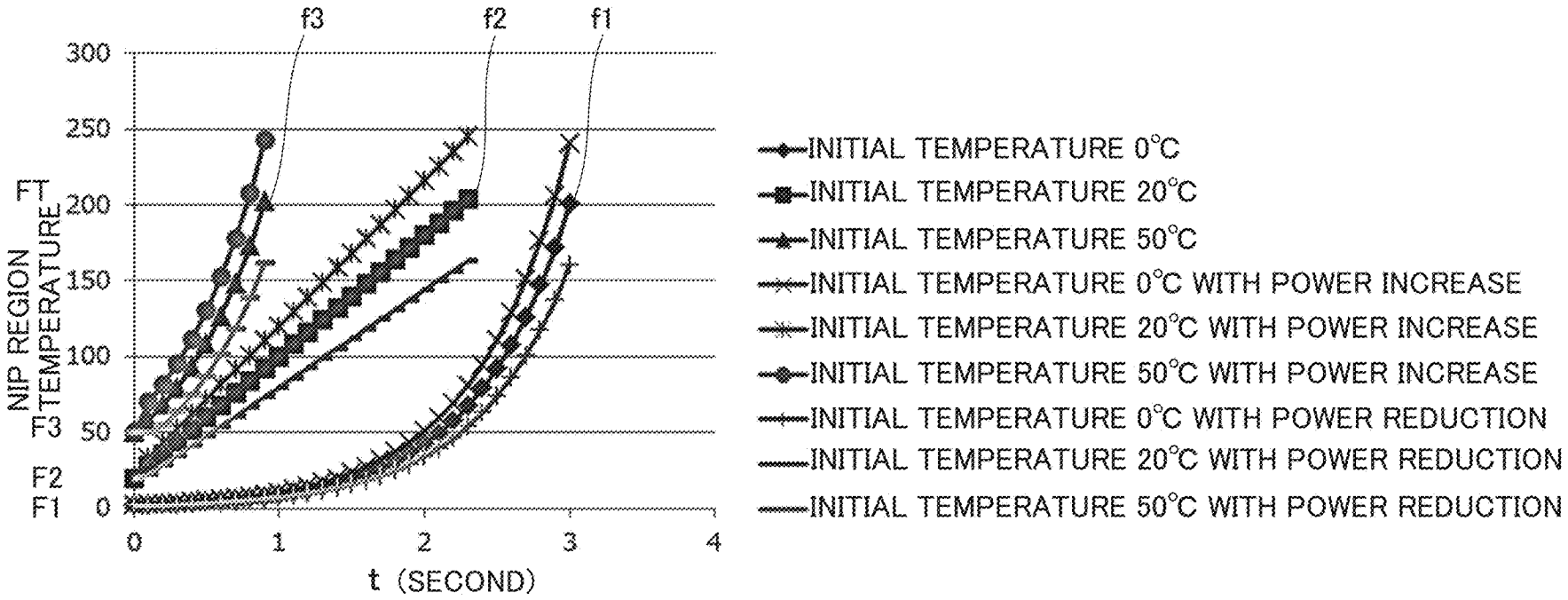
FIG. 7 is a graph showing changes in temperature characteristics caused by increasing and reducing the power supply to the heater, with respect to each of the temperature characteristics shown in FIG. 5.

FIG. 7 is a graph showing changes in temperature characteristics caused by increasing and reducing the AC power supplied to the heater 24 from the heater power source 34, with respect to each of the temperature characteristics f1, f2, and f3 of the nip region N2 shown in FIG. 5. As is apparent from the graph of FIG. 7, the temperature F of the nip region N2 can be controlled, by increasing or reducing the AC power supplied to the heater 24.

Further, the controller 39 may also acquire the change of the temperature F detected by the temperature sensor 35 after the start of power supply to the heater 24, as the temperature characteristic of the nip region N2, in addition to acquiring the temperature F, detected by the temperature sensor 35 before the start of power supply to the heater 24, as the initial temperature FF, and store the initial temperature FF and the temperature characteristic thus acquired in the storage device 36. In this case, the data of the initial temperature FF and the temperature characteristic can be increased, which facilitates the control of the heater 24 based on the temperature characteristic to be performed more precisely. When a plurality of temperature characteristics are stored in the storage device 36 with respect to the same initial temperature FF, these temperature characteristics may be averaged, so that the accuracy of the temperature characteristic can be improved.

Although the color MFP is taken up in the foregoing embodiment as an example of the image forming apparatus according to the disclosure, the disclosure is also applicable to various other image forming apparatuses, such as a monochrome MFP, a printer, a copier, and a facsimile machine.

Further, the configurations and processings described in the foregoing embodiments with reference to FIG. 1 to FIG. 7 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A fixing apparatus comprising:

a fixing device that heats, with a heater, a recording sheet on which an image has been formed by a developing agent, while holding the recording sheet at a nip region with a pressure, thereby fixing the image on the recording sheet;

a temperature sensor that detects a temperature of the nip region;

a storage device containing temperature characteristics of the nip region varying from an initial temperature owing to start of power supply to the heater, with respect to each of a plurality of the initial temperatures of the nip region; and a control device including a processor, and configured to act, when the processor executes a control program, as a controller that;

selects, before the start of power supply to the heater, a temperature characteristic of the initial temperature same as or approximate to a temperature detected by the temperature sensor, out of the temperature characteristics of the respective initial temperatures stored in the storage device;

calculates a predicted temperature to be reached a prescribed time after the start of power supply to the heater, on a basis of the selected temperature characteristic; and increases the power to the heater by a predetermined first value, when a temperature, detected by the temperature sensor the prescribed time after the start of power supply to the heater, is lower than the predicted temperature, wherein the controller executes process to output a warning, when the temperature detected by the temperature sensor has not reached a target value within a predetermined time, despite the increase in power to the heater.

2. A fixing apparatus comprising:

a fixing device that heats, with a heater, a recording sheet on which an image has been formed by a developing agent, while holding the recording sheet at a nip region with a pressure, thereby fixing the image on the recording sheet;

a temperature sensor that detects a temperature of the nip region;

a storage device containing temperature characteristics of the nip region varying from an initial temperature owing to start of power supply to the heater, with respect to each of a plurality of the initial temperatures of the nip region; and a control device including a processor, and configured to act, when the processor executes a control program, as a controller that;

selects, before the start of power supply to the heater, a temperature characteristic of the initial temperature same as or approximate to a temperature detected by the temperature sensor, out of the temperature characteristics of the respective initial temperatures stored in the storage device;

calculates a predicted temperature to be reached a prescribed time after the start of power supply to the heater, on a basis of the selected temperature characteristic; and increases the power to the heater by a predetermined first value, when a temperature, detected by the temperature sensor the prescribed time after the start of power supply to the heater, is lower than the predicted temperature, wherein the controller keeps the power to the heater unchanged, when the temperature detected by the temperature sensor the prescribed time after the start of power supply to the heater is equal to or higher than the predicted temperature.

3. A fixing apparatus comprising:

a fixing device that heats, with a heater, a recording sheet on which an image has been formed by a developing agent, while holding the recording sheet at a nip region with a pressure, thereby fixing the image on the recording sheet;

a temperature sensor that detects a temperature of the nip region;

a storage device containing temperature characteristics of the nip region varying from an initial temperature owing to start of power supply to the heater, with respect to each of a plurality of the initial temperatures of the nip region; and a control device including a processor, and configured to act, when the processor executes a control program, as a controller that;

selects, before the start of power supply to the heater, a temperature characteristic of the initial temperature same as or approximate to a temperature detected by the temperature sensor, out of the temperature characteristics of the respective initial temperatures stored in the storage device;

calculates a predicted temperature to be reached a prescribed time after the start of power supply to the heater, on a basis of the selected temperature characteristic; and increases the power to the heater by a predetermined first value, when a temperature, detected by the temperature sensor the prescribed time after the start of power supply to the heater, is lower than the predicted temperature, wherein the controller reduces the power supplied to the heater by a predetermined second value, when the temperature detected by the temperature sensor the prescribed time after the start of power supply to the heater is equal to or higher than the predicted temperature.

4. The fixing apparatus according to claim 1, wherein, when the temperature detected by the temperature sensor the prescribed time after the start of power supply to the heater is equal to or higher than the predicted temperature, the controller reduces the power to the heater by a predetermined third value, after the temperature detected by the temperature sensor has reached a predetermined fixing temperature to be used for the fixing operation.

5. The fixing apparatus according to claim 1, wherein the fixing device includes:

an endless fixing belt;

a pressure roller contacting the fixing belt to define the nip region in collaboration with the fixing belt; and a ceramic heater acting as the heater to heat the recording sheet via the fixing belt.

6. The fixing apparatus according to claim 1, wherein the controller acquires the temperature detected by the temperature sensor before the start of power supply to the heater, as the initial temperature of the nip region, and also a change of the temperature detected by the temperature sensor after the start of power supply to the heater, as a temperature characteristic of the nip region, and stores the initial temperature and the temperature characteristic acquired, in the storage device.

7. An image forming apparatus comprising:

an image forming device that forms an image created by the developing agent on a recording sheet; and the fixing apparatus according to claim 1.

* * * * *